US007811128B2

(12) United States Patent
Pan

(10) Patent No.: US 7,811,128 B2
(45) Date of Patent: Oct. 12, 2010

(54) ELECTRICAL CONNECTOR HAVING IMPROVED SHIELDING PLATE

(75) Inventor: Feng Pan, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/381,055

(22) Filed: Mar. 5, 2009

(65) Prior Publication Data

US 2009/0227141 A1 Sep. 10, 2009

(30) Foreign Application Priority Data

Mar. 5, 2008 (CN) ..... 2008 1 0018654

(51) Int. Cl.
*H01R 13/648* (2006.01)

(52) U.S. Cl. ..... 439/607.05; 439/607.03; 439/607.07

(58) Field of Classification Search ..... 439/607.02, 439/607.03, 607.05–607.07
See application file for complete search history.

(56) References Cited

U.S. PATENT DOCUMENTS 6,231,391 B1 * 5/2001 Ramey et al. ..... 439/607.07
6,712,646 B2 * 3/2004 Shindo ..... 439/607.07
6,743,057 B2 * 6/2004 Davis et al. ..... 439/701
6,764,349 B2 * 7/2004 Provencher et al. ..... 439/701
6,872,085 B1 * 3/2005 Cohen et al. ..... 439/108
6,899,566 B2 5/2005 Kline et al.
7,186,140 B2 * 3/2007 Chen ..... 439/541.5
7,416,447 B1 * 8/2008 Chen ..... 439/607.05
2008/0020642 A1 * 1/2008 Pan ..... 439/607

* cited by examiner

*Primary Examiner*—Michael C Zarroli
(74) *Attorney, Agent, or Firm*—Ming Chieh Chang; Wei Te Chung; Andrew C. Cheng

(57) ABSTRACT

An electrical connector (1) has an insulative housing (10) including a number of receiving passages (100), a number of terminal modules (20) mounted to the insulative housing and located adjacent to another and shielding plates (3). The terminal module has a base (22) including a first side (223), a plurality of terminals (21) secured to the base and a spacer (23) received to the insluative housing. The shielding plates have at least a first shielding plate (30) assembled to the first side (223) of the terminal module and including a number of tines (31) connected to a printed circuit board, and a second shielding plate (40) assembled to the first side of neighboring terminal module and having a connecting section (41) connected to the first shielding plate.

12 Claims, 11 Drawing Sheets

ELECTRICAL CONNECTOR HAVING IMPROVED SHIELDING PLATE

BACKGROUND OF THE INVENTION

1. Field of the Invention

The present invention relates to an electrical connector, and more particularly to an electrical connector having a plurality of shielding plates having connecting section for connecting a shielding plate to a neighboring shielding plates.

2. Description of the Prior Art

U.S. Pat. No. 6,899,566 issued to Kline on May 31, 2005, discloses an electrical connector for mounting to a mother board. The electrical connector has an insulative housing, plural columns of terminal modules mounted to the insulative housing, and a plurality of shielding plates respectively attached to one side of the terminal module. Each shielding plate is provided with two rows of tails exposed from the base. One row of tails is mounted to the mother board for grounding. During assembly, it is needed to provide a number of circuits formed on the mother board for engaging with the tines of each grounding plate, resulting in complicating the assembly of the shielding plates to the mother board.

Hence, an improved electrical connector is needed to solve the above problem.

BRIEF SUMMARY OF THE INVENTION

One object of the present invention is to provide an electrical connector comprising a plurality of shielding plates for simply mounting to a printed circuit board.

An electrical connector made according to the present invention comprises an insulative housing having a plurality of receiving passages, a plurality of terminal modules mounted to the insulative housing and located adjacent to another and a plurality of shielding plates. The terminal module comprises a base comprising a first side, a row terminals secured to the base and received in the receiving passages of insulative housing, and a spacer received to the insulative housing and having a plurality of partitions defining a plurality of slots each receiving corresponding terminals therein. The shielding plates have at least a first shielding plate and a second shielding plate. The first shielding plate is assembled to the first side of the terminal module and comprises a plurality of tines connected to the printed circuit board. The second shielding plate is assembled to the first side of neighboring terminal module and comprises a connecting section connected to the first shielding plate.

Advantages of the present invention are to provide a first shielding plate provided with a plurality of tines and a second shielding plate having a connecting section directly electrically connected to the tines of first shielding plate so as to connect with the printed circuit board by the tines of the first shielding plate. Therefore, It is easy to assemble the first and the second shielding plates to the printed circuit board by the engagement between the tines of the first shielding plate and circuits of the printed circuit board. Additionally, the cost of the manufacture of the printed circuit board has been reduced.

Other objects, advantages and novel features of the invention will become more apparent from the following detailed description of the present embodiments when taken in conjunction with the accompanying drawings.

DETAILED DESCRIPTION OF THE INVENTION

Figure 1:
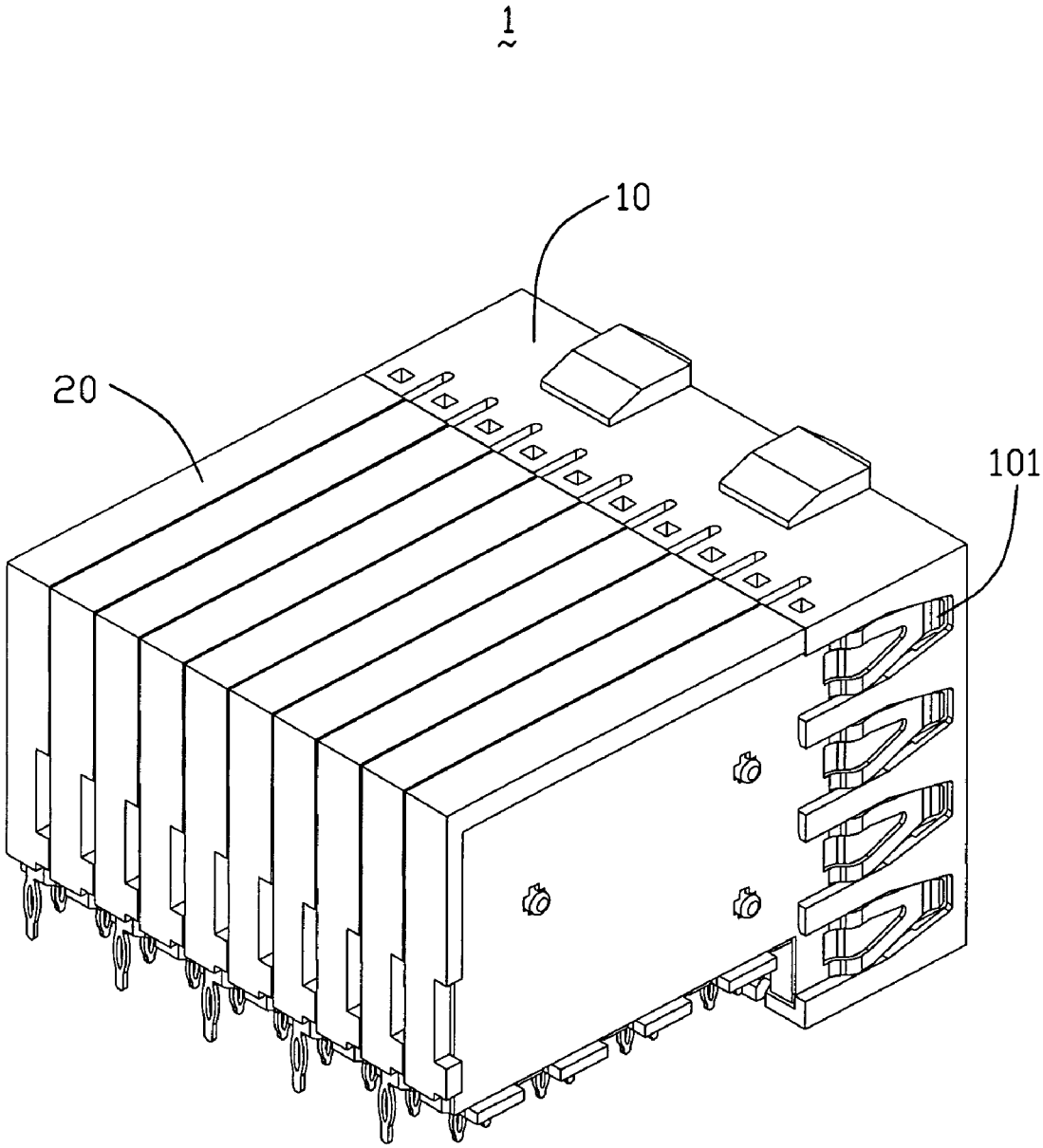
FIG. 1 is an assembled perspective view of an electrical connector in accordance with a first embodiment of the present invention.
Figure 2:
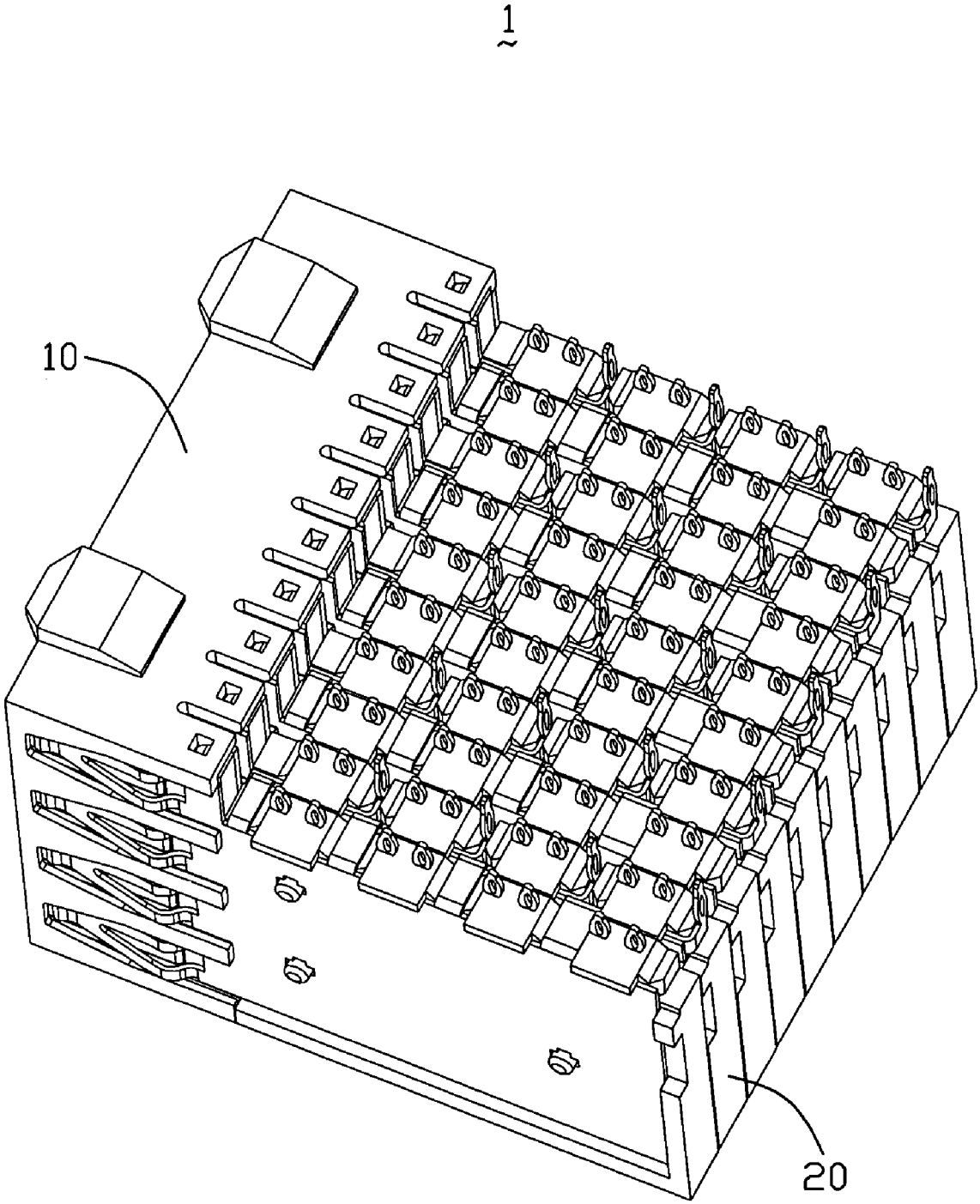
FIG. 2 is a perspective view of the electrical connector as shown in FIG. 1, taken from another aspect.
Figure 3:
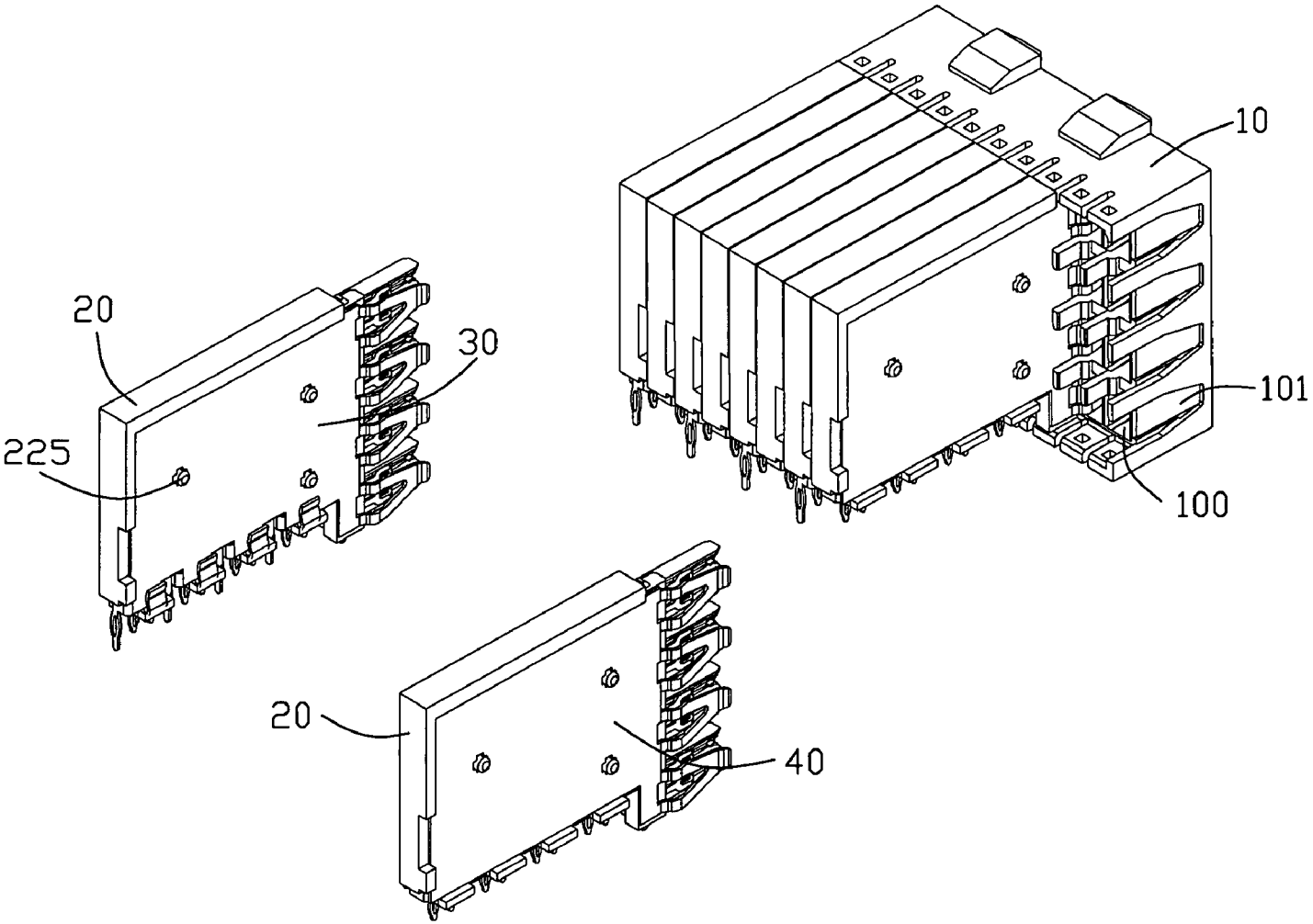
FIG. 3 is a perspective view of a first and a second shielding plate mounted to the corresponding terminal modules.

Reference will now be made to the drawing figures to describe the present invention in detail. Referring to FIGS. 1-4, an electrical connector 1 for mounting on a printed circuit board (not shown) comprises an insulative housing 10 and a plurality of terminal modules 20 mounted to the insulative housing 10, and plural shielding plates 3.

The insulative housing 10 has a plurality of receiving passages 100 and second passages 101 respectively located adjacent to corresponding receiving passages 100.

Referring to FIGS. 3-6, the terminal modules 20 are mounted to the insulative housing 10 and located next to another. The terminal module 20 comprises a base 22 having a first side 223 and an opposite side 221, a plurality of terminals 21 secured to the first side 223 of the base 22 and received in corresponding receiving passages 100 of the insulative housing 10, and a spacer 23 received to the insulative housing 10. The terminals 21 are arranged in a pattern of signal terminals pairs and respectively has an intermediate portion 213 covered by the shielding plate 3, a mating pin 211 extending forwardly from the intermediate portion 213 and received in the receiving passages 100 of the insulative housing 10, and a soldering portions 212 exposed from the base 22 for mounting to the printed circuit board. The spacer 23 has a plurality of partitions defining a plurality of slots 231 each receiving corresponding terminals 21 therein.

Figure 4:
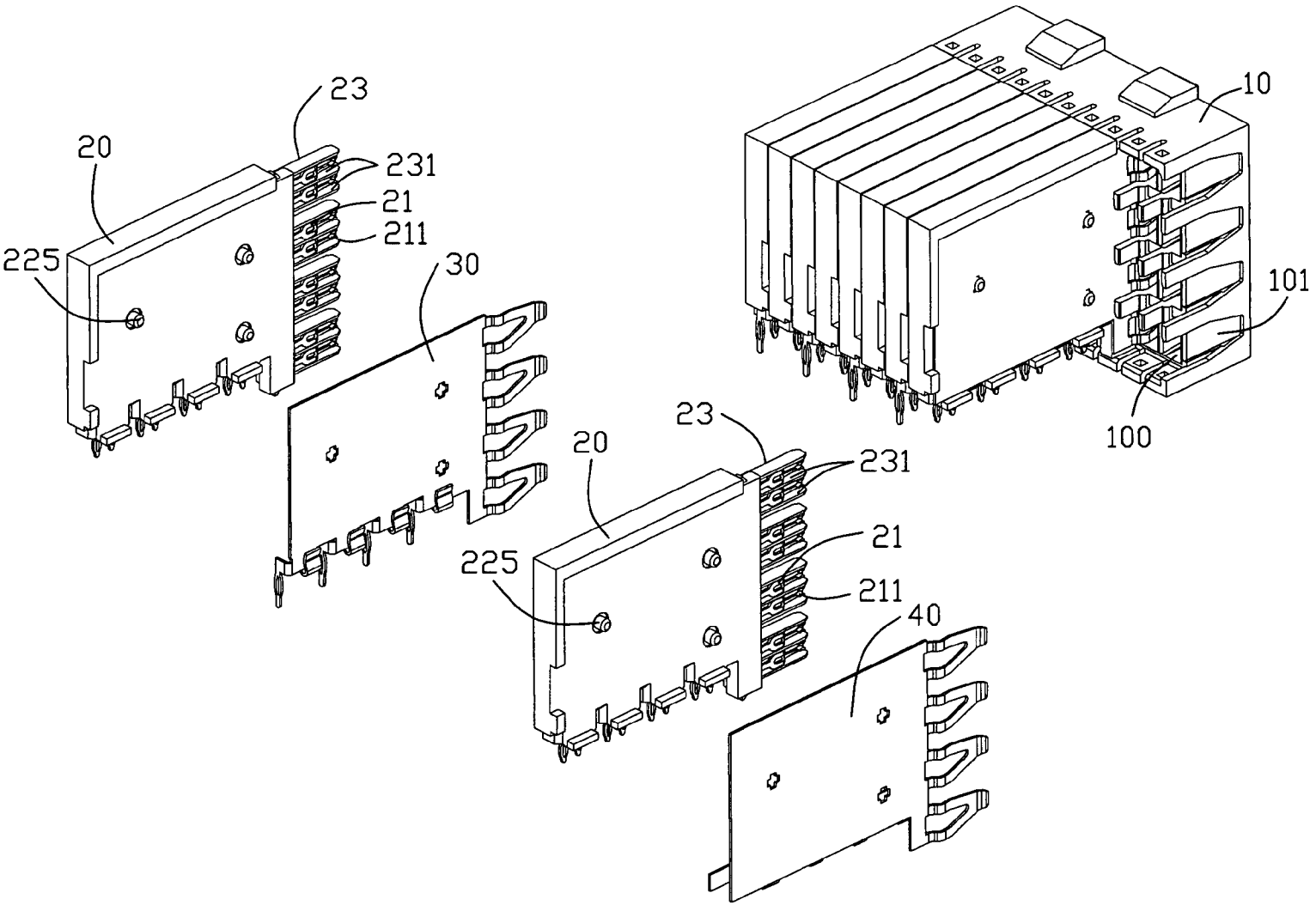
FIG. 4 is a perspective view of a first and a second shielding plate and the terminal modules as shown in FIG. 3.
Figure 5:
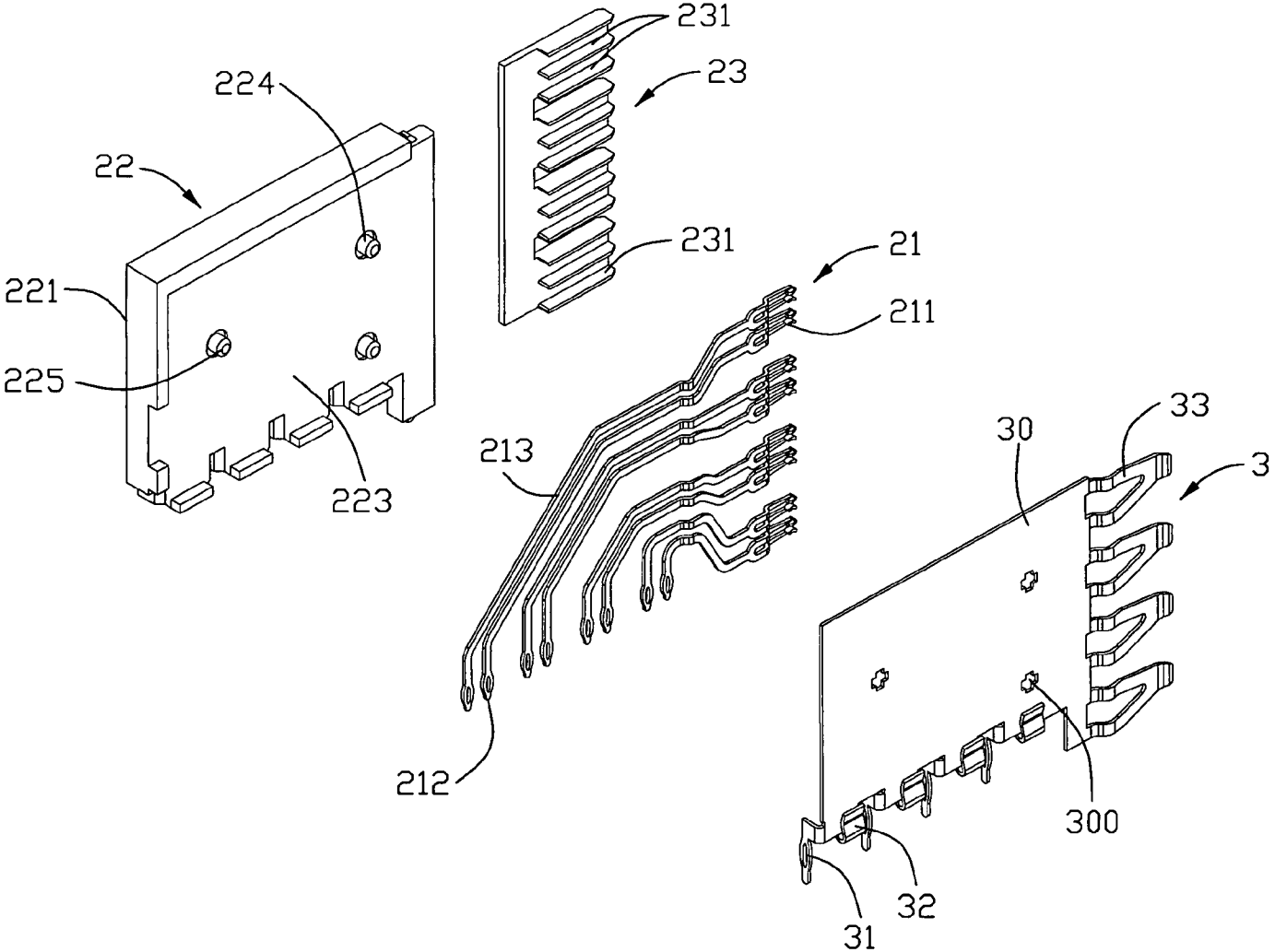
FIG. 5 is an exploded view of the first shielding plate and the terminal module.

Referring to FIGS. 4 and 5, the shielding plate 3 is each punched by a metal strip and have a plurality of first shielding plates 30 respectively assembled to the first side 223 of the base 22 of the terminal module 20 and a plurality of second shielding plates 40 respectively assembled to the first side 223 of neighboring terminal module 20. The first shielding plate 30 comprises a plurality of tines 31 extending outwardly from the base 22. The second shielding plate 40 comprises a connecting section 41 connected to the first shielding plate 30. The connecting section 41 comprises a plurality of legs 412 extending across a bottom surface of the base 22 and a bar 411 bending perpendicularly from the ends of the legs 412 and extending in a lengthwise direction. The first shielding plate 30 comprises a plurality of hooks 32 bending toward the bar 411 for locking with the bar 411 of the second shielding plate 40 which attached to the neighboring terminal module 20. The base 22 of the terminal module 20 comprises a plurality of embosses 225 formed on the first side 223 thereof. The first and second shielding plates 30 and 40 respectively has a plurality of cavities 300 and 400 defined thereon for coupling with the embosses 225. The first and second shielding plates 30 and 40 respectively has a plurality of contacting pins 33 and 43 protruding from the base 22 of the terminal module 20 and received in the second passages 101.

Figure 6:
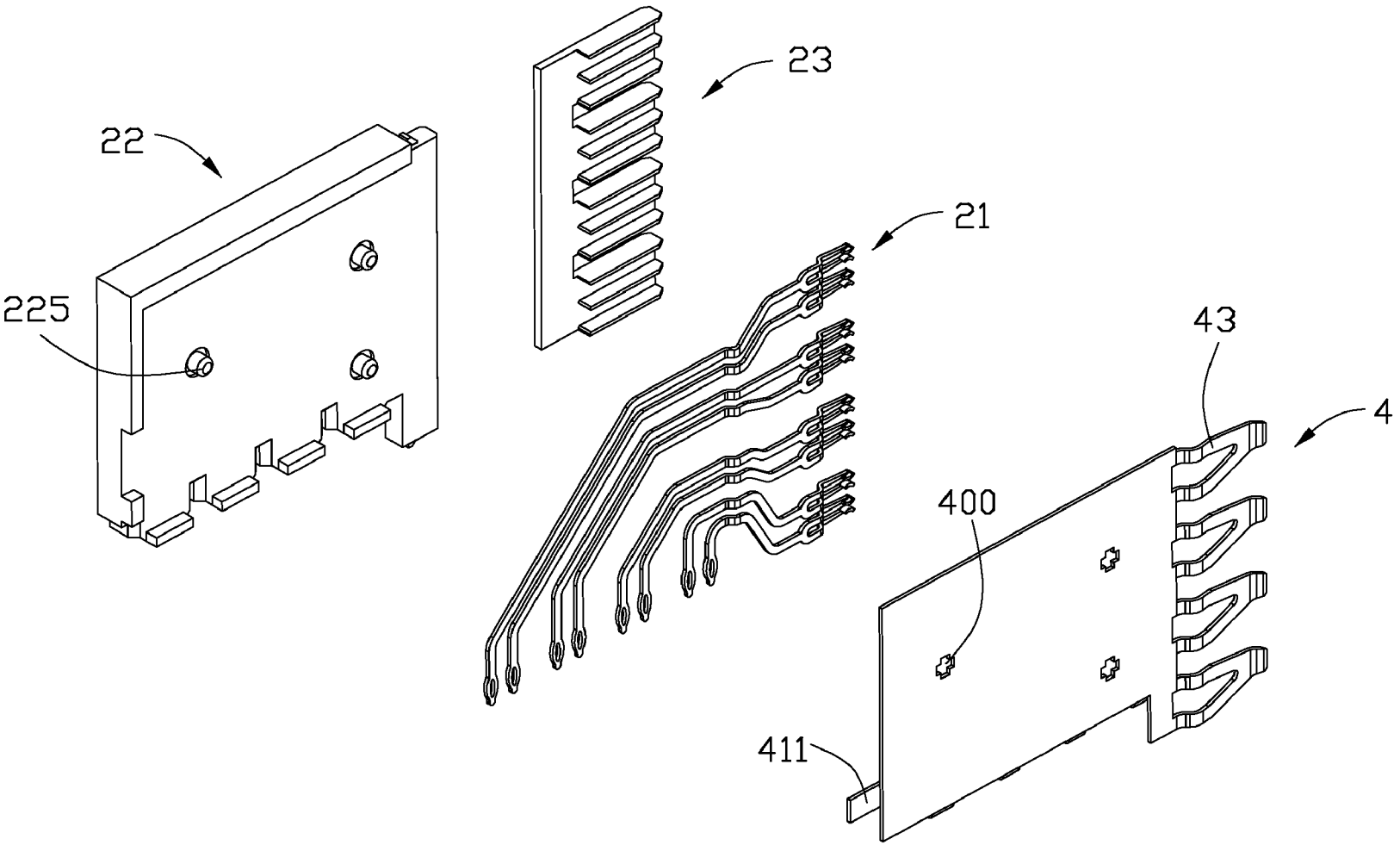
FIG. 6 is an exploded view of the second shielding plate and the terminal module.
Figure 7:
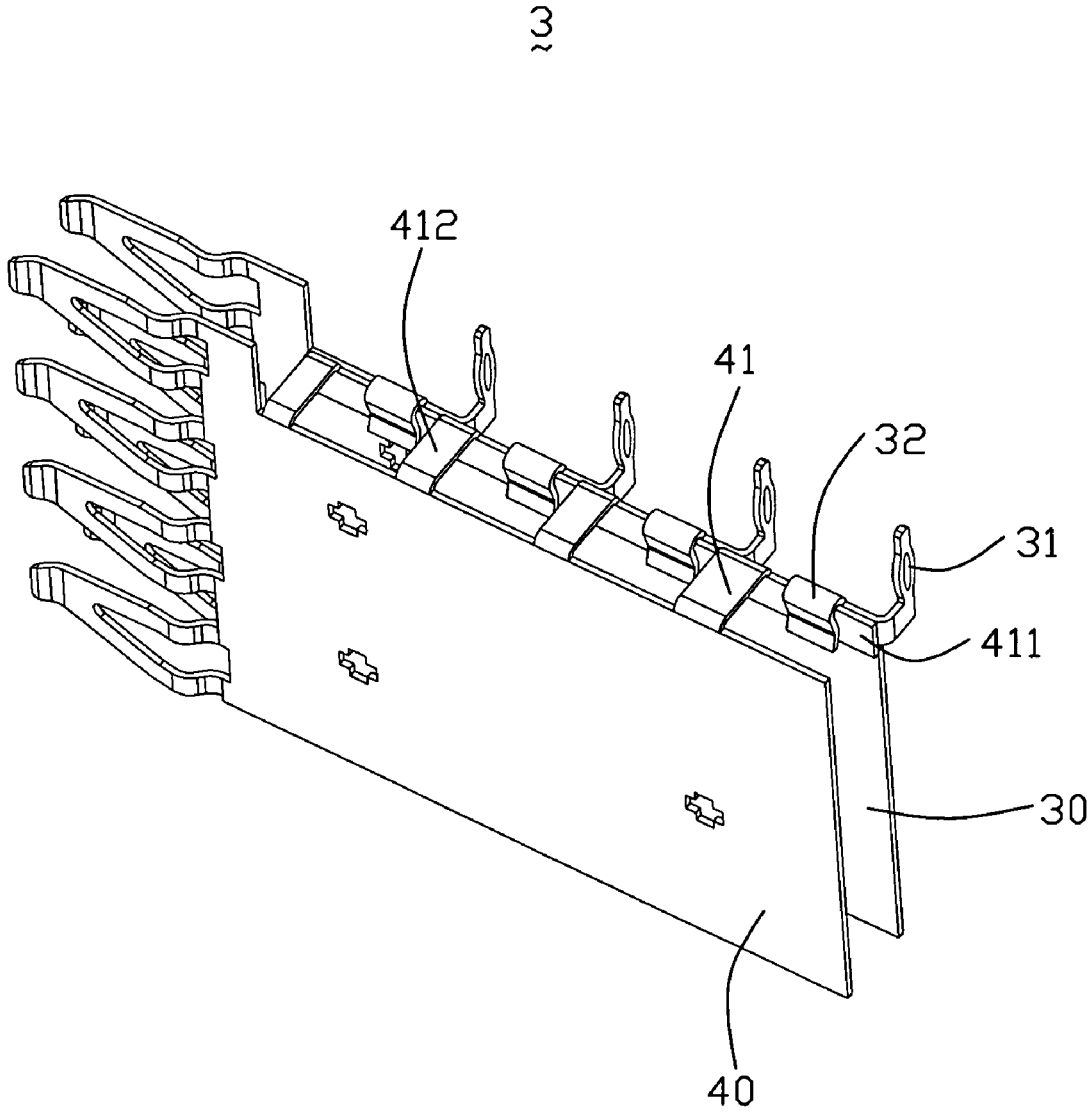
FIG. 7 is a perspective view showing the second shielding plate assembled to the first shielding plate.
Figure 8:
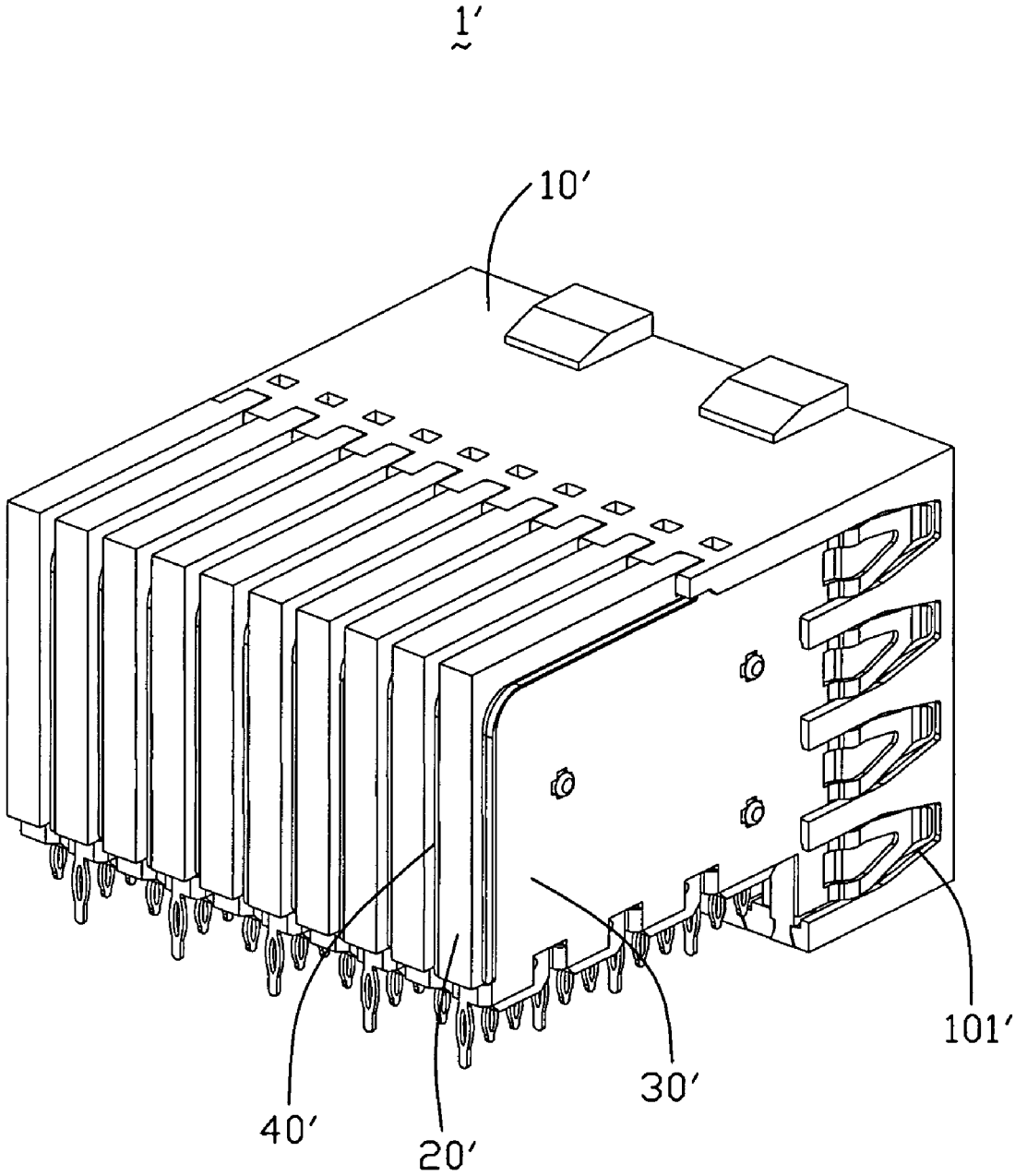
FIG. 8 is an assembled perspective view of an electrical connector in accordance with a second embodiment.

Referring to FIGS. 5 and 6, in assembling of the electrical connector 1, firstly, the first shielding plate 30 is mounted to the first side 223 of the base 22 by the engagement between the embosses 225 and the cavities 300. The second shielding plate 40 is mounted to a neighboring terminal module 20 by the engagement between the embosses 225 and the cavities 400. Secondly, the bar 411 of connection section 41 of the second shielding plate 40 is clamped by the hooks 32 of the first shielding plates 30. Then the terminal modules 20 are mounted to the insulative housing 10. Finally, the first shielding plate 30 and the second shielding plate 40 are mounted to the printed circuit board by the electrically connection of the tines 31 of first shielding plate 30. The soldering portions 212 are inserted to the printed circuit board.

FIGS. 8-11 illustrate a second preferred embodiment of the present invention. In this embodiment, an electrical connector 1' comprises an insulative housing 10' and a plurality of terminal modules 20' mounted to the insulative housing 10', and plural shielding plates 3'.

The insulative housing 10' has columns of receiving passages 100' and columns of second passages 101' located adjacent to the receiving passages 100'.

Figure 9:
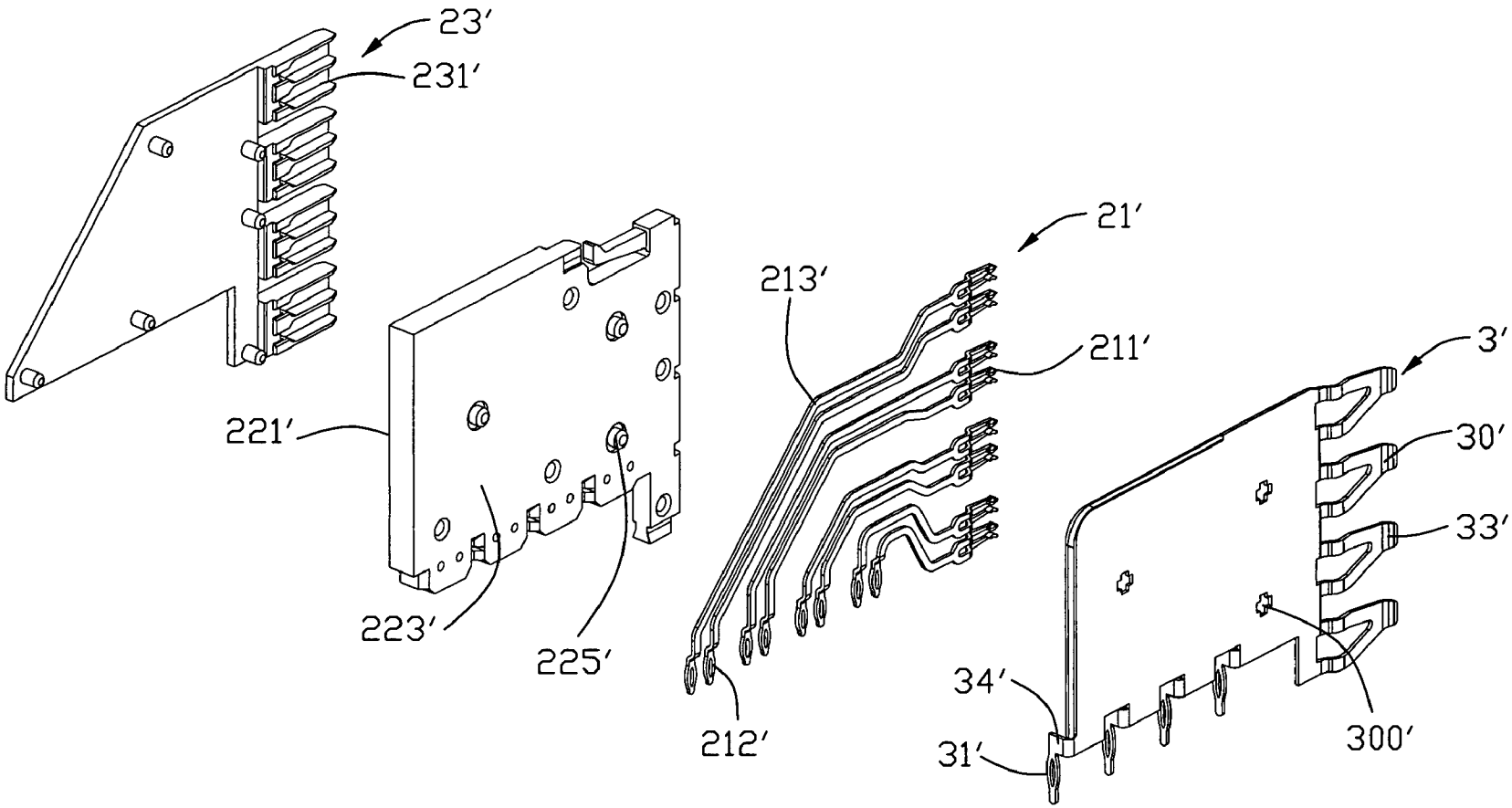
FIG. 9 is an exploded view of the first shielding plate and the terminal module as shown in FIG. 8.
Figure 10:
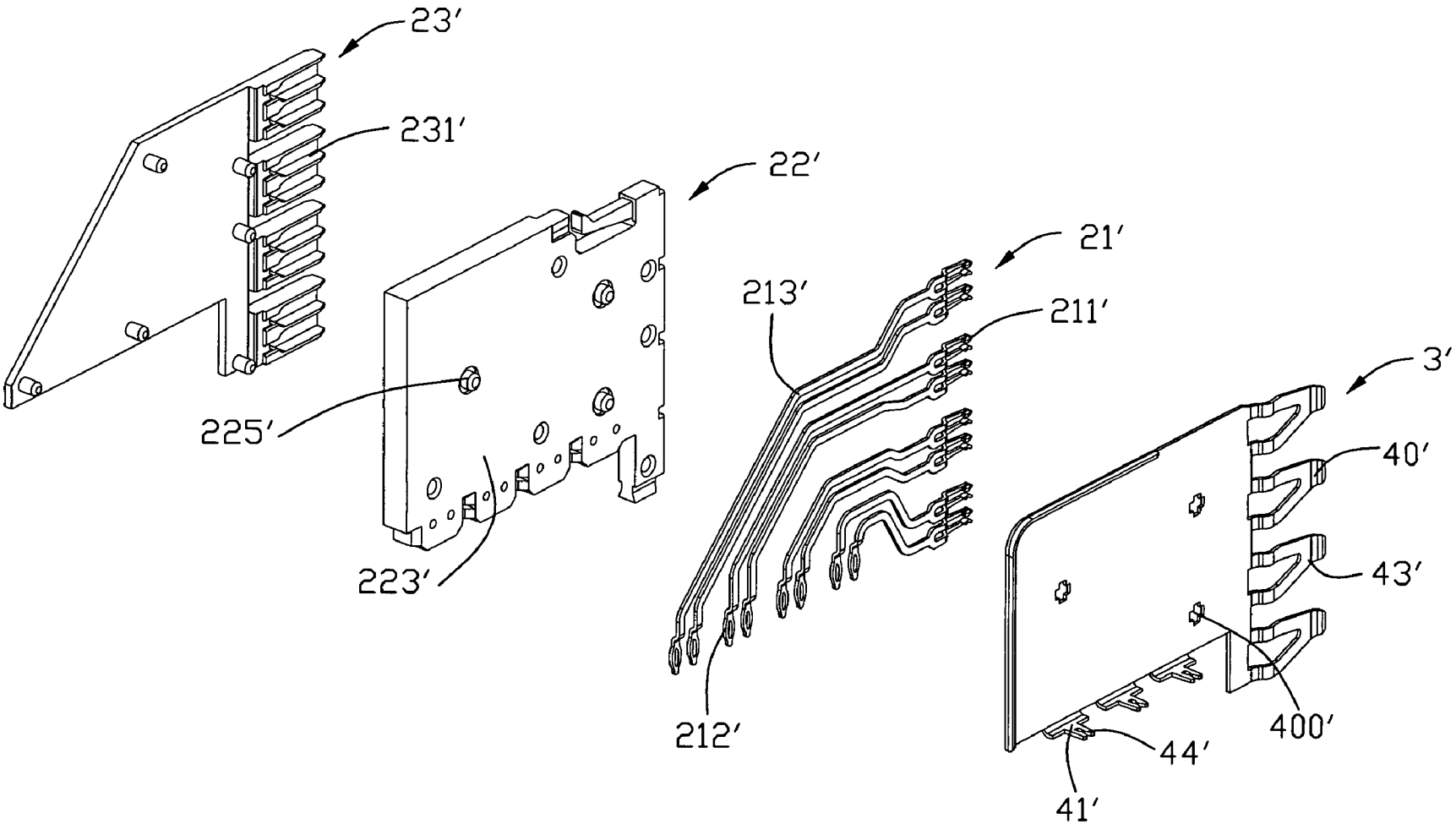
FIG. 10 is an exploded view of the second shielding plate and the terminal module as shown in FIG. 8.
Figure 11:
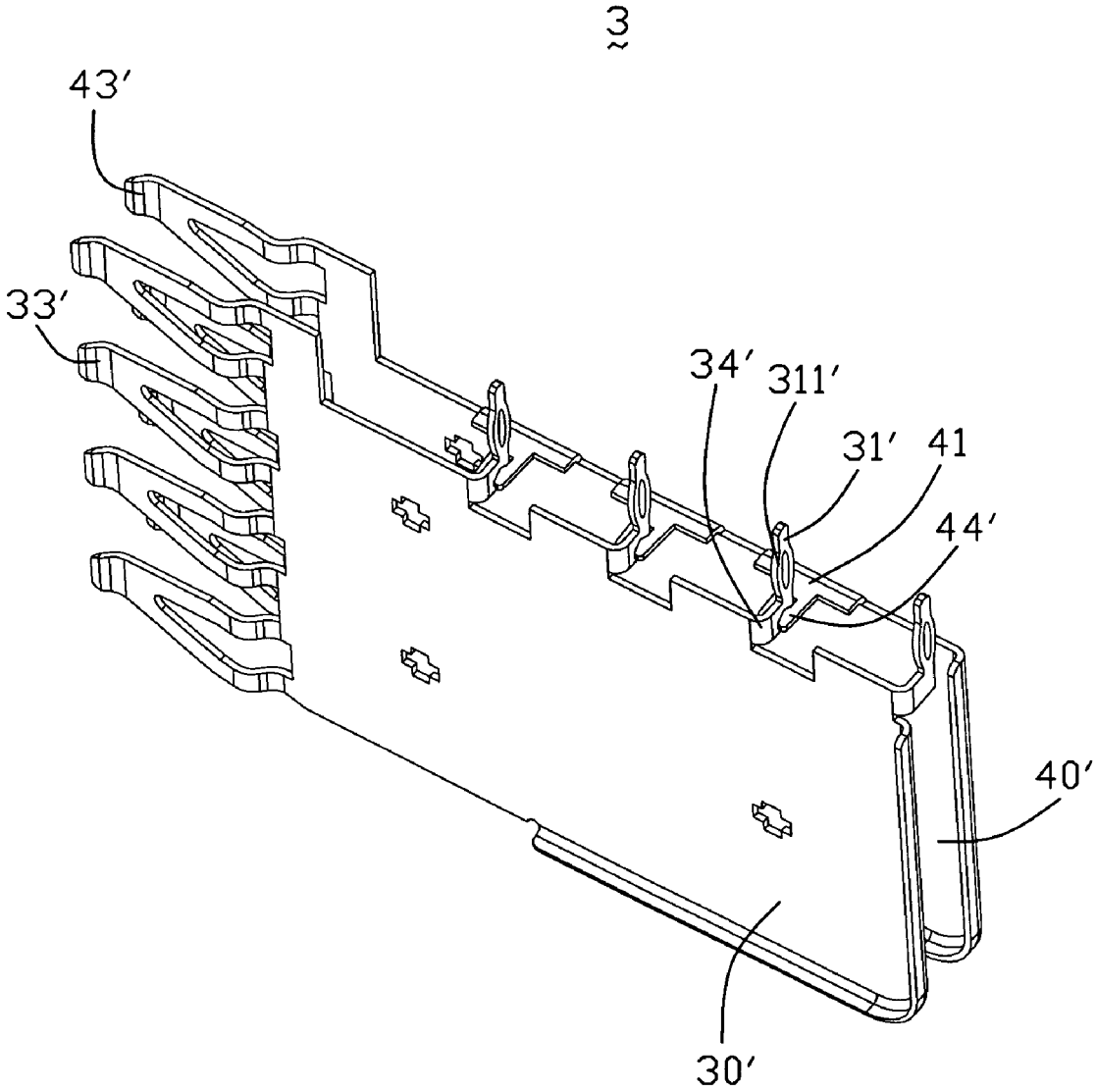
FIG. 11 is a perspective view of the second shielding plate assembled to the first shielding plate as shown in FIG. 8.

The terminal modules 20' are mounted to the insulative housing 10' and located one next to another. Referring to FIGS. 9-11, the terminal module 20' comprises a base 22' having a first side 223' and an opposite side 221', a plurality of terminals 21' secured to the first side 223' of the base 22' and received in corresponding receiving passages 100' of the insulative housing 10', and a spacer 23' attached to the opposite side 221' of the base 22'. The terminals 21' are arranged in a pattern of signal terminals pairs and respectively has an intermediate portion 213' covered by the shielding plate 3', a mating pin 211' extending forwardly from the intermediate portion 213' and received in the receiving passages 100' of the insulative housing 10', and a soldering portions 212' exposed from the base 22' for mounting to the printed circuit board. The spacer 23' is retained in the receiving passage 100' of the insulative housing 10' and has a plurality of partitions defining a plurality of slots 231' each receiving corresponding terminals 21' therein'.

The shielding plates 3' are each punched by a metal strip and have a plurality of first shielding plates 30' respectively assembled to the first side 223' of the base 22' of the terminal module 20' and a plurality of second shielding plates 40' assembled to the first side 223' of neighboring terminal module 20'. The first shielding plate 30' comprises a plurality of tines 31' connected to the printed circuit board. The second shielding plate 40' comprises a connecting section 41' connected to the first shielding plate 30'. The tines 31' of the first shielding plate 30 comprises a first connecting portion 34' bending toward the connecting section 41' of the second shielding plate 40' and a contacting tail 311' mounted to the printed circuit board. The connecting section 41' comprises a plurality of legs 412' extending across a bottom surface of the base 22' and comprising a clamping portion 44' for clamping the first connecting portion 34' of the first shielding plate 30'. The base 22' of the terminal module 20' comprises a plurality of embosses 225' formed on the first side 223' thereof. The first and second shielding plates 30' and 40' respectively has a plurality of cavities 300' and 400' defined thereon for coupling with the embosses 225'. The first and second shielding plates 30' and 40' respectively has a plurality of contacting pins 33' and 43' protruding from the base 22' of the terminal module 20' and received in the second passages 101'.

Referring to FIGS. 8-11, in assembling of the electrical connector 1', firstly, the first shielding plate 30' is mounted to the first side 223' of the base 22' by the engagement between the embosses 225' and the cavities 300'. The second shielding plate 40' is mounted to a neighboring terminal module 20' by the engagement between the embosses 225' and the cavities 400'. Secondly, the first connecting portion 34' of the tines 31' is clamped by the clamping portion 44' of the second shielding plate 40'. Then the terminal modules 20' are mounted to the insulative housing 10'. Finally, the first shielding plates 30' and the second shielding plate 40' are mounted to the printed circuit board by the electrically connection of the tines 31' of first shielding plate 30'. The soldering portions 212' are inserted to the printed circuit board.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector mounted on a printed circuit board, comprising:

an insulative housing comprising a plurality of receiving passages;

a plurality of terminal modules mounted to the insulative housing and located adjacent to another, each terminal module comprising:

a base comprising a first side;

plurality of terminals secured to the base and received in a corresponding receiving passage of the insulative housing;

a spacer received in the receiving passages of the insulative housing and having a plurality of partitions defining a plurality of slots each receiving corresponding terminals therein; and a plurality of shielding plates having at least one first shielding plate and at least one second shielding plate, the first shielding plate being assembled to the first side of the terminal module and comprising a plurality of tines for electrically connecting with a circuit board, the second shielding plate being assembled to the first side of neighboring terminal module and comprising a connecting section connected to the first shielding plate and electrically connecting with the circuit board by the tines of the first shielding plate, wherein said connecting section comprises a plurality of legs extending across a bottom surface of the base for connecting to the first shielding plate, wherein said connecting section comprises a bar bent perpendicularly from the ends of the legs and extending along a lengthwise direction, and wherein said first shielding plate comprises a plurality of hooks bent toward the bar for locking with the bar of the connecting section.

2. The electrical connector as claimed in claim 1 wherein said leg of the second shielding plate comprises a clamping portion for clamping the tines of the first shielding plate.

3. The electrical connector as claimed in claim 2, wherein said tines of the first shielding plate comprises a first connecting portion bent toward the connecting section of the second shielding plate and a contacting tail for mounting to the printed circuit board.

4. The electrical connector as claimed in claim 1, wherein said base of the terminal module comprises a plurality of embosses formed on the first side of the base, and wherein each of the first and second shielding plates has a plurality of cavities defined thereon for coupling with the embosses.

5. The electrical connector as claimed in claim 1, wherein said terminals are arranged in a pattern of signal terminal pairs and located onto the first side of the base, the terminal having an intermediate portion covered by the shielding plate and a soldering portion exposed outside the base for mounting to the printed circuit board.

6. The electrical connector as claimed in claim 1, wherein said insulative housing has plural columns of second passages, each column of second passages is located adjacent to an associated receiving passage, and each of the first and the second shielding plates has a plurality of contacting pins protruding from the base of the terminal module and received in the second passages.

7. The electrical connector as claimed in claim 1, wherein said connecting section of the second shielding plate is connected with the first shielding plate at a position adjacent to the tines.

8. An electrical connector for use between a complementary connector and a printed circuit board, comprising:

a plurality of terminal module units side by side arranged with one another;

a plurality of terminals extending in each of said terminal module units, each of said terminals defining a mating section, for mating with the complementary connector, and a mounting section, for mounting to the printed circuit board, extending out of different faces of the terminal module unit;

a plurality of first shielding plates and a plurality of second shielding plates alternately side by side arranged with each other, each of said first shielding plates cooperating with the neighboring second shielding plate to sandwich the corresponding terminal module unit therebetween; wherein in each neighboring pair of said first shielding plate and said second shielding plate, both said first shielding plate and the second shielding plate have the corresponding mating portions, respectively, for mating with the complementary connector while sharing a same group of mounting portions for grounding to the printed circuit board, said same group of mounting portions being derived from only one of said first shielding plate and said second shielding plate.

9. The electrical connector as claimed in claim 8, wherein in each neighboring pair of said first shielding plate and said second shielding plate, the first shielding plate and the second shielding plate are fastened to each other around the mounting portions.

10. The electrical connector as claimed in claim 9, wherein said neighboring first shielding plate and second shielding plate are restrained from moving away from each other in a transverse direction perpendicular to a front-to-back direction and a vertical direction.

11. The electrical connector as claimed in claim 8, wherein said terminal module unit further includes a spacer to regulate positions of the corresponding terminals thereof.

12. An electrical connector mounted on a printed circuit board, comprising:

an insulative housing comprising a plurality of receiving passages;

a plurality of terminal modules mounted to the insulative housing and located adjacent to another, each terminal module comprising:

a base comprising a first side;

a plurality of terminals secured to the base and received in a corresponding receiving passage of the insulative housing;

a spacer received in the receiving passages of the insulative housing and having a plurality of partitions defining a plurality of slots each receiving corresponding terminals therein; and a plurality of shielding plates having at least one first shielding plate and at least one second shielding plate, the first shielding plate being assembled to the first side of the terminal module and comprising a plurality of tines, the second shielding plate being assembled to the first side of neighboring terminal module and comprising a connecting section connected to the first shielding plate; wherein said connecting section comprises a plurality of legs extending across a bottom surface of the base for connecting to the first shielding plate; wherein said leg of the second shielding plate comprises a clamping portion for clamping the tines of the first shielding plate.

* * * * *